US006889701B2

(12) United States Patent
Kovacik et al.

(10) Patent No.: US 6,889,701 B2
(45) Date of Patent: May 10, 2005

(54) AIR HOSE REEL

(75) Inventors: James D. Kovacik, Brecksville, OH (US); Paul S. Blanch, Broadview Heights, OH (US); Joseph J. Smith, Wooster, OH (US)

(73) Assignee: Alert Stamping & MFG CO, INC, Bedford Hts, OH (US)

( * ) Notice: Subject to any disclaimer, the term of this patent is extended or adjusted under 35 U.S.C. 154(b) by 170 days.

(21) Appl. No.: 10/603,909

(22) Filed: Jun. 25, 2003

(65) Prior Publication Data

US 2004/0163710 A1 Aug. 26, 2004

Related U.S. Application Data

(63) Continuation-in-part of application No. 10/373,338, filed on Feb. 24, 2003.

(51) Int. Cl.[7] ..... F16K 1/00; F16K 43/00

(52) U.S. Cl. ..... 137/15.18; 137/554; 137/557; 137/884

(58) Field of Search ..... 137/355.23, 355.26

(56) References Cited

U.S. PATENT DOCUMENTS

| | | | |
|---|---|---|---|
| 3,619,518 | A | 11/1971 | Blanch et al. |
| 3,715,526 | A | 2/1973 | Blanch et al. |
| 3,808,382 | A | 4/1974 | Blanch et al. |
| 4,350,850 | A | 9/1982 | Kovacik et al. |
| 4,725,697 | A | 2/1988 | Kovacik et al. |
| 4,726,538 | A | 2/1988 | Kovacik et al. |
| 4,759,560 | A | 7/1988 | Vergulti |
| 5,381,820 | A | 1/1995 | Chandler |
| 5,645,147 | A | 7/1997 | Kovacik et al. |
| 5,666,992 | A | 9/1997 | Robins |
| 5,732,733 | A | 3/1998 | Negus et al. |
| 6,170,775 | B1 | 1/2001 | Kovacik et al. |
| 6,273,354 | B1 | 8/2001 | Kovacik et al. |
| 6,439,360 | B1 | 8/2002 | Miller |

*Primary Examiner*—A. Michael Chambers
(74) *Attorney, Agent, or Firm*—MacMillan, Sobanski & Todd, LLC

(57) ABSTRACT

A reel for storing an air hose includes a hollow housing having a spring biased pulley rotatably mounted therein. A pressured air inlet extends through the housing along the pulley axis of rotation and is sealed to a nozzle rotating with the pulley. The pulley stores an air hose having one end connected to the nozzle and an opposite end extending through an opening in the housing for attachment to a pneumatic tool.

13 Claims, 5 Drawing Sheets

FIG - 5
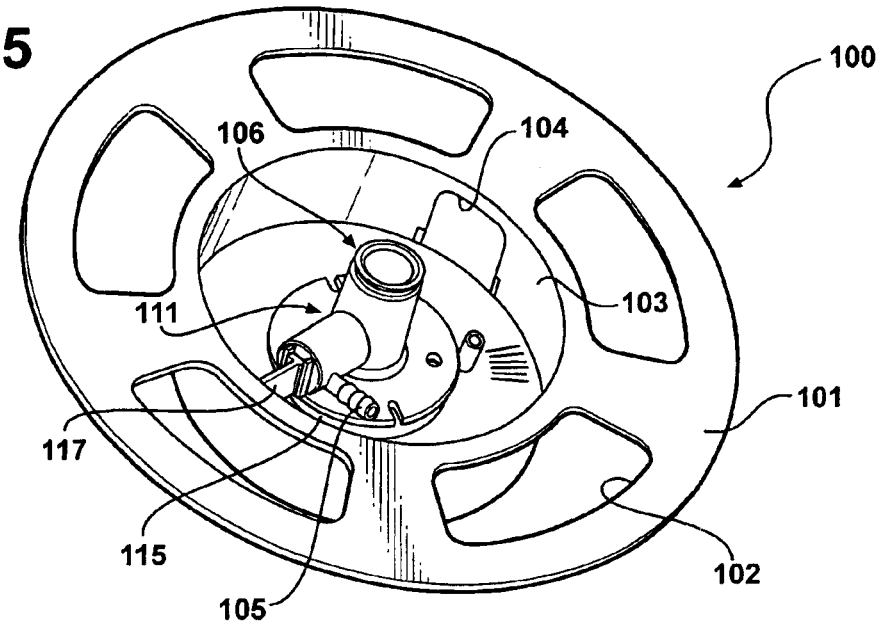
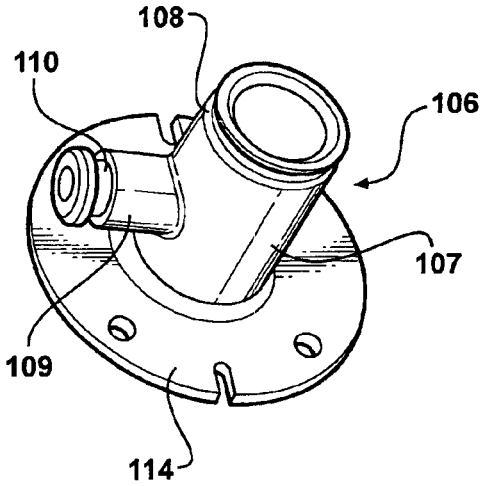
FIG - 6
FIG - 7
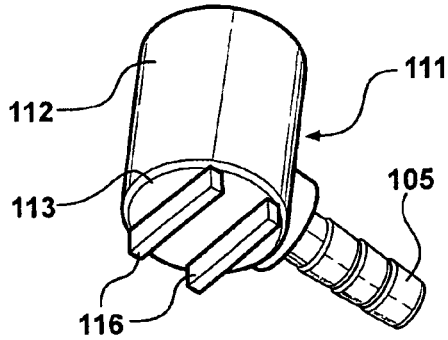

AIR HOSE REEL

CROSS-REFERENCE TO RELATED APPLICATION

This application is a continuation-in-part of the co-pending U.S. patent application Ser. No. 10/373,338 filed Feb. 24, 2003.

BACKGROUND OF THE INVENTION

The present invention relates generally to air hose reels and, in particular, to a reel for storing and deploying an air hose to be connected between a source of pressured air and a pneumatic tool which reel can be mounted for use in a specific location and easily detached from its mounting bracket and used remotely.

Air hoses are well known and are typically utilized to connect a source of pressured air to various pneumatically powered tools such as paint atomizers, cutters, grinders, drills, screwdrivers, hammers, rivet guns, impact wrenches, ratchets, sanders and polishers, among others. Take-up reels for managing the use and storage of air hoses and electrical cords are well known. Such reels consist basically of a spool rotatably affixed to a structural component whereby the spool is manually or automatically rotated to wind an elongated hose or cord thereabout. Typically, such automatic reels employ a variety of spring and ratchet mechanisms for maintaining the hose/cord in the extended position and rewinding the hose/cord onto the spool when it is no longer needed. Such reels are particularly useful in industrial or commercial settings such as automobile repair shops, machine shops, carpentry shops and construction sites. These reels permit workers to readily access pressurized air as needed for the operation of portable pneumatic tools at various locations remote from an existing air compressor. In addition, the use of air hose reels makes it possible to provide only a short air fitting, such as a coupling or the like, on the various pneumatic tools thereby simplifying the movement and storage of the disconnected pneumatic tools.

While exterior designs may vary, retracting reels for electric cords and air hoses basically include a spool mounted on a shaft supported for rotation on a bracket or housing, and a cooperating ratchet and pawl to arrest the rotation of the spool when the air hose or electric cord has been paid out to a desired length, and a spring for rotating the spool in a direction to rewind the air hose or electric cord when the ratchet and pawl are disengaged. Such electrical cord reels are shown, for example, in the U.S. Pat. Nos.: 3,619,518; 3,715,526; 3,808,382; 4,726,538; and 6,273,354.

Various types of air hose reels are shown in the U.S. Pat. Nos.: 4,759,560; 5,381,820; 5,666,992; and 5,732,733. These prior art reels disadvantageously do not provide a closed protective housing and satisfactory means for sealing the air pressure at the connections within the housing of the air reel.

It is desirable, therefore, to provide an air hose reel that overcomes the disadvantages of the prior art noted above. It remains desirable, therefore, to provide a cost-effective and functional air hose reel that provides a satisfactory means for enclosing the hose and sealing the air pressure at the connections within the housing of the air reel.

SUMMARY OF THE INVENTION

The present invention concerns an air hose reel for storing an air hose and connecting the air hose with a pressurized air supply. The air hose reel includes a hollow reel housing having first and second cup-shaped housing halves, each of the housing halves having a generally inverted U-shaped handle portion extending outwardly therefrom, the handle portions cooperating to form a handle for hand carrying the air hose reel. A generally U-shaped mounting bracket for attaching the air hose reel to a mounting surface is attached by a rod extending through apertures formed in the mounting bracket and apertures formed in at least one of the handle portions, the rod detachably attaching the housing to the mounting bracket. A nut releasably attaches to the rod and prevents removal of the rod from the mounting bracket apertures and the at least one handle portion apertures. A flange is mounted on an exterior of the second half of the housing, the flange including a first tubular portion extending outwardly from the reel housing and adapted to be connected to a source of pressured air, and a second tubular portion extending inside the reel housing and in fluid communication with the first tubular portion, the second tubular portion having an annular groove formed in an exterior surface and an O-ring retained in the groove.

A pulley is rotatably mounted inside the reel housing on an axis of rotation. A nozzle is mounted on the pulley, the nozzle having a tubular nozzle inlet receiving the second tubular portion, the O-ring sealing between the exterior surface of the second tubular portion and an interior surface of the nozzle inlet, the nozzle having a nozzle outlet in fluid communication with the nozzle inlet, the nozzle outlet extending transverse to the axis of rotation. A reel hose is wound on the pulley, the reel hose having one end attached to the nozzle outlet by a hose clamp and an opposite end extending through the housing aperture. A shaft is mounted in the first half of the reel housing, the shaft rotatably supporting the pulley. A return spring is mounted in the pulley for automatically winding up the reel hose, the return spring having one end attached to the pulley and an opposite end attached to the shaft.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 5 is a perspective view of an alternate embodiment pulley half according to the present invention;

FIG. 6 is a perspective view of the nozzle plate shown in FIG. 5; and

FIG. 7 is a perspective view of the nozzle shown in FIG. 5.

DESCRIPTION OF THE PREFERRED EMBODIMENT

Figure 1:
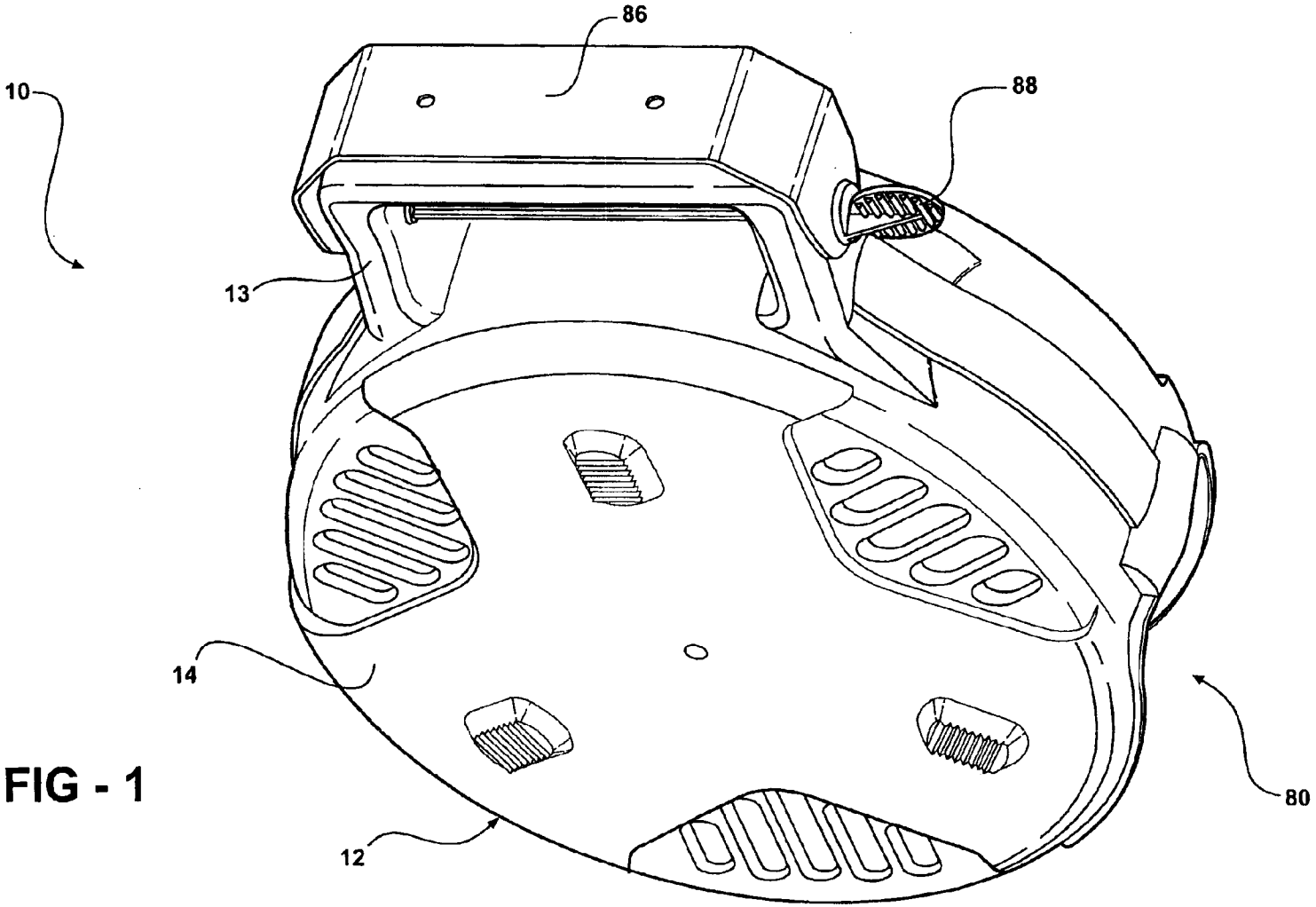
FIG. 1 is a perspective view of an air hose reel in accordance with the present invention.
Figure 2:
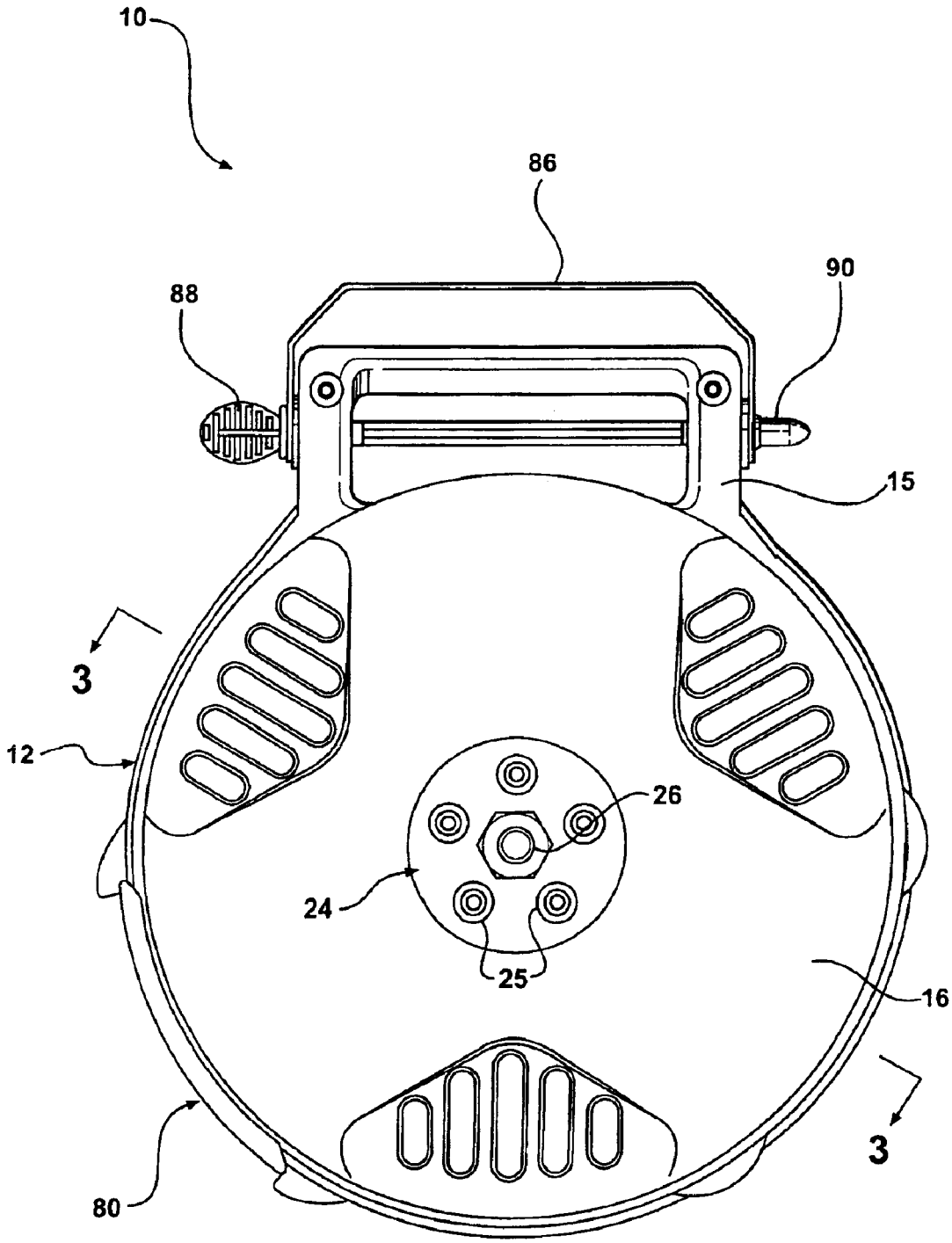
FIG. 2 is right side elevation view of the air hose reel shown in FIG. 1.
Figure 3:
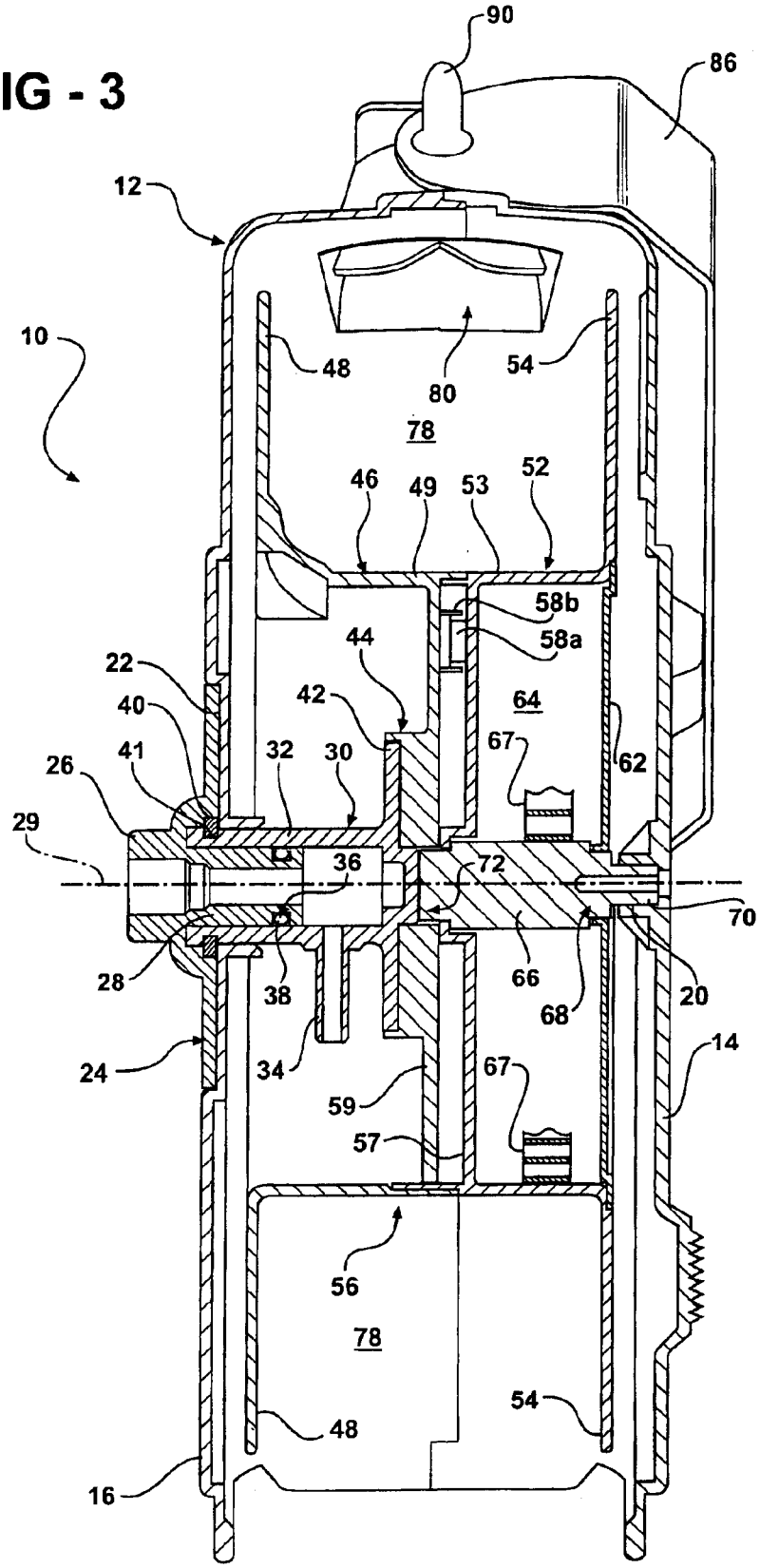
FIG. 3 is a cross-sectional view of the air hose reel taken along line 3—3 in FIG. 2.
Figure 4:
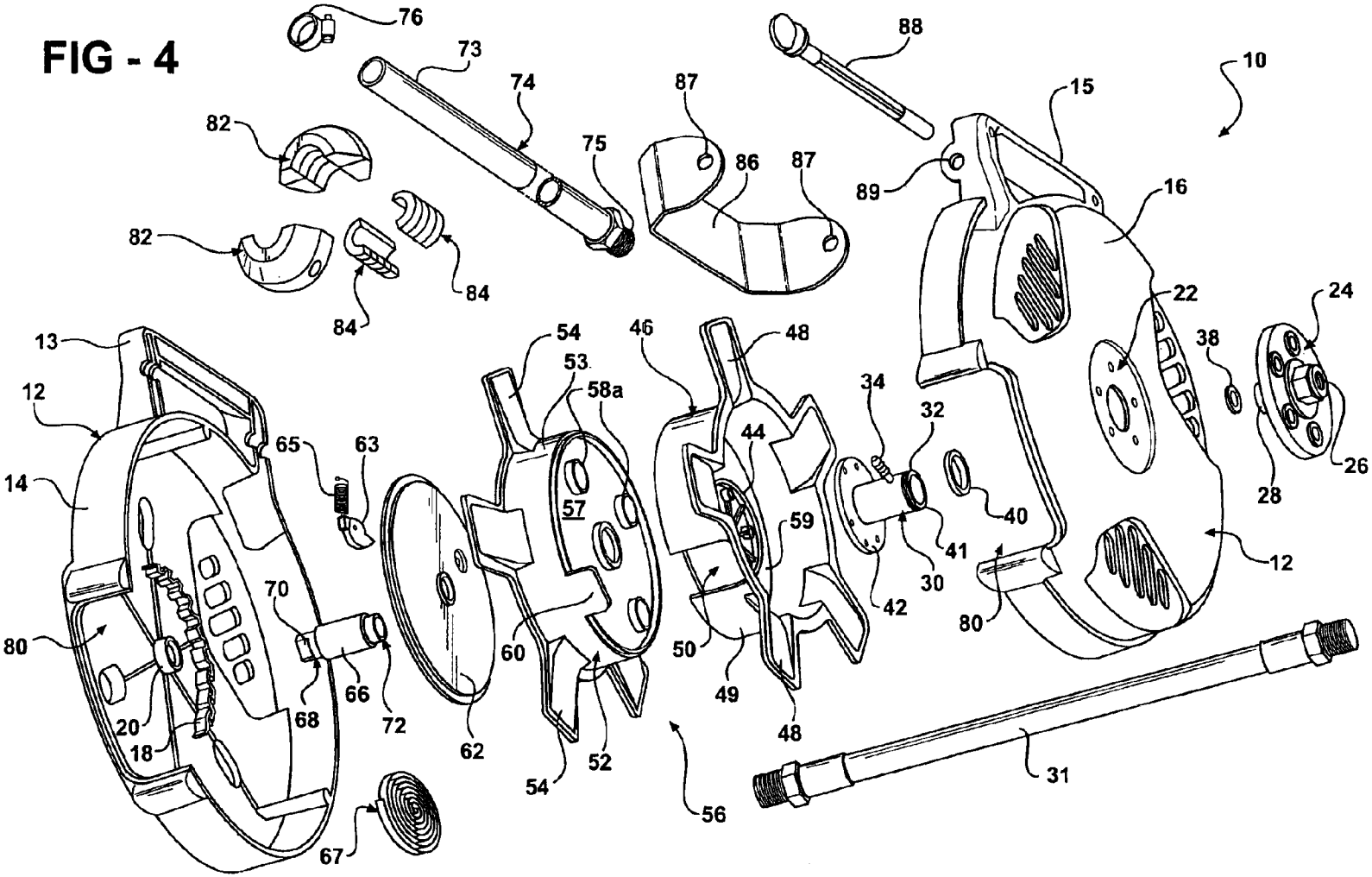
FIG. 4 is an exploded perspective view of the air hose reel shown in FIG. 1.

Referring now to FIG. 14, an air hose reel in accordance with the present invention is indicated generally at 10. The air hose reel 10 includes a hollow reel housing 12 formed from a pair of cup-shaped halves, a first or left half 14 and a second or right half 16. The housing 12 includes an inverted U-shaped handle formed from a first or left handle portion 13 extending from a top surface of the housing first half 14 and a second or right handle portion 15 extending from a top surface of the housing second half 16. As best seen in FIG. 4, an inner surface of the housing first half 14 has a plurality of detent members 18 formed thereon and a mounting boss 20 extending upwardly from a center portion thereof. An outer surface of the housing second half 16 defines a recess 22 that receives a flange 24. The flange 24 is attached to the outer surface of the housing second half 16 by a plurality of fasteners 25 (FIG. 2). The flange 24 includes a first tubular portion 26 extending outwardly therefrom and a second tubular portion 28 extending inwardly therefrom. The tubular portions 26 and 28 are coaxial and define an axis of rotation 29 (FIG. 3) discussed below. The first tubular portion 26 threadably connects to a threaded end of an air supply hose 31. The air supply hose 31 is approximately three feet long and preferably is connected to a compressed air supply (not shown) such as an outlet of an air compressor, a compressed air receiver or the like. The first tubular portion 26 of the flange 24, therefore, functions as an external air inlet for the air hose reel 10.

An air hose nozzle 30 includes a tubular nozzle inlet 32 that receives the second tubular portion 28 that extends through a central aperture in the outer surface of the housing second half 16. A tubular nozzle outlet 34 extends radially from an outer surface of the inlet 32 and is in fluid communication with the interior of the inlet. The second tubular portion 28 includes an annular groove 36 (FIG. 3) formed in the outer surface thereof for receiving and retaining an O-ring 38. The O-ring 38 provides a rotating air seal between the outer surface of the second tubular portion 28 and the inner surface of the nozzle inlet 32. A snap ring 40 is received in an annular groove 41 formed in the outer surface of a free end of the inlet 32 and the snap ring is trapped between the flange 24 and the housing second half 16 to secure the nozzle 30 to the housing 12. The nozzle outlet 34 functions as an outlet for the pressured air provided to the hose reel 10 through the air supply hose 31.

The air hose nozzle 30 also includes a radially extending flange 42 formed at an end of the nozzle inlet 32 opposite the groove 41. The flange 42 is attached to a mounting boss 44 extending axially outwardly from an internal surface of a generally disk-shaped first pulley half 46. The flange 42 is attached to the mounting boss 44 by a plurality of fasteners (not shown).

The first pulley half 46 includes a plurality of radially extending flanges 48 evenly spaced about a periphery of an outer edge of a first winding drum half 49. The winding drum 49 outer wall has an aperture 50 formed therein extending from an inner edge to permit access to the nozzle outlet 34. A second pulley half 52 has a second winding drum half 53 with a plurality of radially extending flanges 54 evenly spaced about a periphery of an outer edge of the second drum half. The first pulley half 46 and the second pulley half 52, when attached at the inner edges as shown in FIG. 3, form a pulley, indicated generally at 56. A radially extending wall 57 of the second pulley half 52 includes a plurality of axially outwardly extending female bosses 58*a* that mate with corresponding axially outwardly extending male bosses 58*b* (FIG. 3) on a facing radially extending wall 59 of the first pulley half 46. A tab 60 (FIG. 4) extends axially from the inner edge of the second winding drum half 53 to partially close the aperture 50. The inner edges of the drum halves 49 and 53 interlock, as shown in FIG. 3, which assists in the attachment of the first pulley half 46 and the second pulley half 52. A cover plate 62 is attached to the outer edge of the second winding drum half 53 opposite the wall 57. The cover plate 62 and the wall 57 define a cavity 64 (FIG. 3) therebetween.

A pawl member 63 is rotatably mounted on a boss (not shown) or similar mounting location formed on an outer surface of the end plate 62. An end of the pawl member 63 is attached to one end of a tension spring 65. The other end of the tension spring member is attached to the outer surface of the end plate 62. The pawl member 63 cooperates with the plurality of detent members 18 during rotation of the pulley 56 and the end plate 62.

A generally cylindrical shaft 66 extends through a coiled return spring 67 that is retained in the cavity 64. The shaft 66 includes a reduced diameter first end 68 with a pair of opposed flats 70 formed thereon and an opposed reduced diameter second end 72. The first end 68 of the shaft member 66 fits into the mounting boss 20 of the housing first half 14 with the flats 70 cooperating with a correspondingly shaped central aperture of the mounting boss 20 for preventing rotation of the shaft member 66 with respect to the first half 14. An inner end of the return spring 67 is attached to the larger diameter central portion of the shaft 66. An outer end of the spring 67 is attached to the second winding drum half 52. Thus, as the pulley 56 is rotated to unwind an air hose, the spring 67 will be wound up to automatically rewind the air hose.

As shown in FIG. 4, a reel hose 74 is attached at a first end 73 thereof to the nozzle outlet 34 by a hose clamp 76. The reel hose 74 extends from the nozzle outlet 34 through the aperture 50 and into a space 78 between the flanges 48 and 54. A second end 75 of the reel hose 74 extends through an aperture 80 formed in the housing first and second halves 14 and 16 respectively. The reel hose 74 is approximately twenty-five feet long and the second end 75 is adapted to be attached to a pneumatic tool (not shown) or the like. The reel hose 74 includes a ball stop 82 attached thereto with a split insert 84 to aid in retaining the ball stop 82 on the hose 74. The ball stop 82 and insert 84 are attached to a portion of the reel hose 74 external to the reel case 12 near the end 75. The ball stop 82 has an exterior diameter larger than the aperture 80. The ball stop 82 is operable to stop the accidental retraction of the second end 75 of the air hose 74 into the space 78 during operation of the air hose reel 10, outlined in more detail below.

A generally U-shaped mounting bracket 86 has a pair of apertures 87 formed in opposed legs that are spaced to fit over the first and second handle portions 13 and 15. A rod 88 extends through the apertures 87 and a pair of corresponding apertures 89 formed in the second handle portion 15 to releasably attach the mounting bracket 86 to the reel housing 12. The rod 88 can be retained by a nut 90, or similar fastening device. When the mounting bracket 86 is attached to a mounting surface (not shown) by any suitable means, the reel housing 12 can be rotated about a longitudinal axis of the rod 88.

It can be appreciated that the air hose reel 10 is easy to assemble. The spring 67, the shaft 66, the pawl 63, the end plate 62, the pulley 56, and the nozzle 30 are assembled as a pulley subassembly. The hose 74 is attached to the nozzle outlet 34 of the nozzle 30 by the hose clamp 76, with the end 75 of the hose 74 extending through the aperture 50. The first end 68 of the shaft member 66 is then mounted in the mounting boss 20. The flange 24 is attached to the second half 16 of the reel housing 12 and the first half 14 and the second half 16 are joined with the end 75 of the hose extending through the aperture 80. The air supply hose 31 is then attached to the first tubular portion 26 to complete the air hose reel 10. The first half 14 and the second half 16 are preferably attached at respective circumferential surfaces thereof by a plurality of fasteners (not shown).

The assembled air hose reel 10 may be then mounted by the bracket 86 to any suitable mounting surface. The air hose reel 10 may also be advantageously detached from the mounting bracket 86 and carried to a job site utilizing the handle portions 13 and 15.

There is shown in FIG. 5 an alternate embodiment first pulley half 100 that includes a radially extending flange 101 having a plurality of evenly spaced openings 102 formed therein. The flange 101 extends about a periphery of an outer edge of a first winding drum half 103. The winding drum 103 outer wall has an aperture 104 formed therein extending from an inner edge to permit access to a nozzle outlet 105. A second pulley half (not shown) has a similar flange and winding drum half configuration to be attached to the first pulley half 100 and form a pulley as an alternative to the pulley 56 shown in FIGS. 3 and 4.

An air hose nozzle plate 106 shown in FIG. 6 is similar to the nozzle 30 and includes a tubular nozzle inlet 107 that receives the second tubular portion 28 (FIG. 3) that extends through a central aperture in the outer surface of the housing second half 16. The second tubular portion 28 includes the annular groove 36 (FIG. 3) formed in the outer surface thereof for receiving and retaining the O-ring 38. The O-ring 38 provides a rotating air seal between the outer surface of the second tubular portion 28 and the inner surface of the nozzle inlet 107. The snap ring 40 (FIG. 3) is received in an annular groove 108 formed in the outer surface of a free end of the inlet 107 and the snap ring is trapped between the flange 24 and the housing second half 16 to secure the nozzle plate 100 to the housing 12. A tubular nozzle coupler 109 extends radially from an outer surface of the inlet 107 and is in fluid communication with the interior of the inlet. An annular groove 110 is formed in the outer surface of the coupler 109 for receiving and retaining an O-ring (not shown).

A nozzle tube 111 is shown in FIG. 7 and has a tubular body 112 with the nozzle outlet 105 extending radially therefrom and being in fluid communication with an interior of the body. The body 112 has a closed end 113 and an opposite open end that receives the coupler 109 in a sealing relationship. Thus, air entering the nozzle inlet 107 will flow through the coupler 109 and the body 112 to exit at the nozzle outlet 105, which outlet functions as an outlet for the pressured air provided to the hose reel 10 through the air supply hose 31. The nozzle plate 106 and the nozzle tube 111 function together as a nozzle in the same manner as the nozzle 30.

The air hose nozzle plate 106 also includes a radially extending flange 114 formed at an end of the nozzle inlet 107 opposite the groove 108. The flange 114 is attached to a mounting boss 115 (FIG. 5) extending axially outwardly from an internal surface of the first pulley half 100. The flange 114 is attached to the mounting boss 44 by a plurality of fasteners (not shown). The closed end 113 of the nozzle tube 111 has a pair of spaced apart tabs 116 extending outwardly therefrom. As shown in FIG. 5, the tabs 116 cooperate with a wall 117 extending axially outwardly from the same internal surface of the first pulley half 100 as does the mounting boss 44. The tabs 116 and the wall 117 prevent both rotational and axial movement of the nozzle tube 111 relative to the coupler 109.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An air hose reel for storing an air hose and connecting the air hose with a pressurized air supply, comprising:

a hollow reel housing having an aperture formed therein;

a flange mounted on an exterior of said reel housing, said flange including a first tubular portion extending outwardly from said reel housing and adapted to be connected to a source of pressured air, and a second tubular portion extending inside said reel housing and in fluid communication with said first tubular portion, said second tubular portion having an annular groove formed in an exterior surface and an O-ring retained in said groove;

a pulley rotatably mounted inside said reel housing on an axis of rotation, said pulley including a pair of complementary reel halves each having a radially extending flange extending about a periphery of an outer edge of a winding drum half, said flanges forming a reel hose retaining space therebetween;

a nozzle mounted on said pulley, said nozzle having a tubular nozzle inlet receiving said second tubular portion, said O-ring sealing between said exterior surface of said second tubular portion and an interior surface of said nozzle inlet, said nozzle having a nozzle outlet in fluid communication with said nozzle inlet, said nozzle outlet extending transverse to said axis of rotation; and a reel hose being wound on said pulley about said winding drum halves and between said flanges, said reel hose having one end attached to said nozzle outlet and an opposite end extending through said housing aperture.

2. The air hose reel according to claim 1 including an air supply hose attached to said first tubular portion of said flange.

3. The air hose reel according to claim 1 including a return spring attached to said pulley for automatically rewinding said reel hose.

4. The air hose reel according to claim 1 including a handle extending from said reel housing for hand carrying the air hose reel.

5. The air hose reel according to claim 1 including a mounting bracket releasably attached to said reel housing for attaching the air hose reel to a mounting surface.

6. The air hose reel according to claim 1 wherein said flanges each have a plurality of openings formed therein.

7. An air hose reel for storing an air hose and connecting the air hose with a pressurized air supply, comprising:

a hollow reel housing;

a pulley rotatably mounted inside said reel housing on an axis of rotation for receiving a reel hose;

a nozzle mounted on said pulley, said nozzle having a tubular nozzle inlet extending along said axis of rotation and a tubular nozzle coupler extending transverse to said axis rotation; and a nozzle tube having a body with an open end receiving said nozzle coupler outlet and a nozzle outlet for connection to the reel hose.

8. The air hose reel according to claim 7 wherein said nozzle outlet extends radially from said body.

9. The air hose reel according to claim 7 wherein said body has a pair of spaced apart tabs formed thereon, said pulley has a wall formed thereon and said wall is received between said tabs thereby preventing at least one of rotational and axial movement of said nozzle tube relative to said nozzle coupler.

10. The air hose reel according to claim 7 wherein at least one of said nozzle inlet and said nozzle coupler has an O-ring groove formed in an outer surface thereof.

11. An air hose reel for storing an air hose and connecting the air hose with a pressurized air supply, comprising:

a hollow reel housing;

a pulley rotatably mounted inside reel housing on an axis of rotation for receiving a reel hose;

a nozzle plate mounted on said pulley, said nozzle plate having a tubular nozzle inlet extending along said axis of rotation and a tubular nozzle coupler extending transverse to said axis of rotation; and a nozzle tube having a body with an open end receiving said nozzle coupler outlet and a nozzle outlet extending radially from said body for connection to the reel hose.

12. The air hose reel according to claim 11 wherein said body has a pair of spaced apart tabs formed thereon, said pulley has a wall formed thereon and said wall is received between said tabs thereby preventing at least one of rotational and axial movement of said nozzle tube relative to said nozzle coupler.

13. The air hose reel according to claim 11 wherein at least one of said nozzle inlet and said nozzle coupler has an O-ring groove formed in an outer surface thereof.

* * * * *